United States Patent [19]

Little et al.

[11] 4,076,525

[45] Feb. 28, 1978

[54] HIGH STRENGTH FRACTURE RESISTANT WELDABLE STEELS

[75] Inventors: Clayton D. Little, Fort Worth; Paul M. Machmeier, Benbrook, both of Tex.

[73] Assignee: General Dynamics Corporation, Fort Worth, Tex.

[21] Appl. No.: 709,751

[22] Filed: Jul. 29, 1976

[51] Int. Cl.[2] ..... C22C 38/52

[52] U.S. Cl. ..... 75/128 B; 75/128 W; 148/2; 148/12.3; 148/38

[58] Field of Search ..... 75/128 B, 128 W; 148/38, 2, 12.3

[56] References Cited

U.S. PATENT DOCUMENTS

| | | | |
|---|---|---|---|
| Re. 28,523 | 8/1975 | Hill et al. | 75/128 B |
| 3,502,462 | 3/1970 | Dabkowski et al. | 75/128 B |

*Primary Examiner*—Arthur J. Steiner
*Attorney, Agent, or Firm*—Charles E. Schurman

[57] ABSTRACT

A weldable alloy steel having improved fracture toughness and stress corrosion resistance at very high strength levels in which the essential composition, according to percent by weight is in the range of 0.12 - 0.17% carbon, 1.8 - 3.2% chromium, 0.9 - 1.35% molybdenum, 11.5 - 14.5% cobalt, and 9.5 - 10.5% nickel, the remainder being substantially iron, i.e., with minor amounts of certain impurities and residual elements. Very good stress corrosion resistance and fracture toughness at high strength levels is produced when these elements are alloyed in the percent by weight ranges of 0.15 - 0.17% carbon, 1.8 - 2.2% chromium, 0.9 - 1.1% molybdenum, 13.5 - 14.5% cobalt, and 9.5 - 10.5% nickel. Good fatigue endurance is achieved. Minor amounts of manganese also may be present.

25 Claims, 4 Drawing Figures

HIGH STRENGTH FRACTURE RESISTANT WELDABLE STEELS

The invention herein described was made in the course of or under a contract or subcontract thereunder, with the Department of the Air Force.

BACKGROUND OF THE INVENTION

This invention relates to weldable, alloy steels having high ultimate tensile and yield strength in combination with both high stress corrosion resistance and high toughness which together make it desirable for aerospace vehicular and other fracture critical structures. Design requirements for structural metallic materials used in airplane or like usage include a high strength to weight ratio, high stress corrosion resistance, high fracture or notch toughness, and ease of fabrication. A stress corrosion resistance to fracture toughness ($K_{ISCC}/K_{IC}$) ratio greater than 0.5 is highly desirable for aircraft structural components as well as any application where the maximum operating load is two or less times the steady state sustained load. Such a ratio insures that no stress corrosion cracking will occur during sustained load operation if the structure is designed to resist brittle fracture at maximum operating load. ($K_{ISCC}$ and $K_{IC}$ are the stress intensities (Ksi $\sqrt{\text{inch}}$) below which stress corrosion cracking will not occur within 1000 hours in 3.5% NaCl and brittle fracture will not occur, respectively).

As referred to herein, fracture resistance is measured in terms of notch toughness (CVN), a measure of resistance to fracture under impact loading in ft-lbs in presence of a notch, and fracture toughness ($K_{IC}$), which is resistance to fracture under loading in presence of a crack. In the steels of the present invention fracture toughness measured as Charpy V-notch (CVN) can be closely correlated empirically with the measurement obtained by the fracture mechanics test for $K_{IC}$. Fracture resistance is also a function of stress corrosion resistance — ($K_{ISCC}$) which measures resistance to crack growth in a corrosive environment under sustained load in the presence of a crack.

The art is replete with steels which have been developed for broad spectrum usage as well as for special needs including the needs of the aerospace industry. Many of the prior steels used for aerospace applications, e.g., HY-180, 300M, D6ac, maraging steels and others, provide various combinations of strength, fracture toughness and stress corrosion resistance. Some may also be welded. For example, U.S. Pat. No. 3,502,462 to Dabkowski et al for Nickel, Cobalt, Chromium Steel discloses steels in the range of up to about 197 Ksi maximum yield strength (tensile) having excellent toughness and stress corrosion resistance. There has been a need, however, particularly in the aerospace field for a steel which is at once weldable and provides the best combination of low weight with good stress corrosion resistance and toughness at higher strength levels than heretofore available, particularly up to about 270 Ksi ultimate strength (TUS) or about 245 Ksi yield strength (TYS). Good fatigue endurance limits are also required. Steel groups which are currently available for service at these strength levels are the low alloy medium carbon quench and temper steels, maraging steels, and high strength stainless steels. Also, high toughness (fracture toughness or notch toughness) at high strength levels does not necessarily indicate that a high stress corrosion resistance will be obtained.

The low alloy medium carbon steels in this strength range require carbon contents in excess of 0.3% to meet strength requirements at the expense of fracture and stress corrosion resistance and weldability. The principal strengthening mechanism is the tempering of the carbon martensites which produce a precipitation of carbide particles generally detrimental to high toughness and stress corrosion resistance at this strength level. However, as carbon alone is increased there is an increased tendency for microcracking due to increased lattice strains present as a result of higher tetragonal distortion. This condition can be somewhat alleviated by adding substantial amounts of solid strengtheners, e.g., Ni., Cr., Co., Mn., which will reduce the level of carbon necessary to attain high strength. These alloys, although still categorized as quench and temper steels, and having improved toughness and stress corrosion resistance due to the alloy martensitic matrix yet are below the strength levels found desirable for those structures requiring the highest strength with improved toughness and stress corrosion resistance.

Maraging steels develop high strength as a result of complex precipitation reactions in a low carbon iron-nickel martensite formed above room temperature. Titanium and aluminum are added so that during aging the maximum strengthening will occur by formation of complex nickel-aluminum, nickel-titanium, and nickel-molybdenum intermetallic compounds in the high toughness martensite matrix. As a result more toughness is possible at higher strength levels than is attainable in ordinary quench and temper steels. However, such intermetallic compounds, which are used for strengthening, tend to reduce the stress corrosion resistance. Also, the necessary presence of titanium and aluminum in these steels require caution to keep the residual elements at low levels, these elements being strong carbide, nitride and oxide formers. Formation of an excess of these compounds is difficult to prevent in making of these steels and if present will result in substantial reductions in tougness. Further, since highly cored fusion zone structures are inherent to the maraging system the toughness of the weld deposit is usually always below that of the parent metal.

High strength stainless steels capable of obtaining ultimate tensile strength exceeding 220 Ksi and yield strengths above 210 Ksi are usually of the semiaustenitic or martensitic precipitation hardening type. In general all these alloys have high chromium contents necessary for good corrosion resistance, but as a group have low fracture toughness and stress corrosion resistance, particularly when heat treated to the maximum strength. Some of these steels also are not suited for use at cryogenic temperatures as fracture toughness may decrease appreciably. Although some of the steels are partially austenitic in the solution treated condition at room temperature, it is possible to complete the transformation to martensite by a series of thermal treatments or by cold working to gain increased strength. Some of the TRIP group of the stainless steels when subjected to thermomechnaical working may improve fracture toughness at high strength levels. However, the latter, unlike steels of the present invention, are limited by factors such as plate thickness size and other factors.

None of the referred to prior steels, however, provide the desired levels of fracture toughness and stress corrosion resistance at the high strengths achieved by steels as taught herein.

SUMMARY OF THE INVENTION

Responding to the need for steels combining weldability and high levels of strength with improved high levels of fracture toughness and stress corrosion resistance, it has been found that steels which can be welded provide significantly increased utility where the ultimate strength (tensile) lies in the range of from about 220 Ksi to about 270 Ksi and yield strengths from about 210 Ksi to about 245 Ksi, and has high fracture toughness of greater than about 115 Ksi $\sqrt{\text{inch}}$ particularly where stress corrosion resistance (cracking resistance) is equal to or greater than about 60 Ksi $\sqrt{\text{inch}}$ based on testing for 1000 hours in a 3.5% sodium chloride solution.

None of the heretofore available steels reach these strength levels while providing the herein disclosed levels of stress corrosion resistance and toughness. Nor do prior available steels have these properties coupled with the capability of forming good welds. The steels of this invention are unusual in this respect as, surprisingly, all of these properties may be at high levels simultaneously.

Thus, an object of this invention is to provide a weldable alloy steel having strength properties of from about 210–245 Ksi yield strength and 220–270 Ksi ultimate strength which has greater fracture toughness than previously available at these levels;

Another object is to provide an alloy steel having a fracture toughness ($K_{IC}$) of at least 115 Ksi $\sqrt{\text{inch}}$ at tensile strengths above about 210 Ksi;

Yet another object is to provide an alloy steel having a stress corrosion cracking resistance ($K_{ISCC}$) equal to or greater than 60 Ksi $\sqrt{\text{inch}}$ at tensile strengths of 210 Ksi or above when tested for 1000 hours in 3.5% NaCl solution;

Still another object is to provide an alloy steel having good weldability properties using conventional arc welding processes;

A further object is to develop an alloy steel having a fatigue endurance limit at $10^7$ cycles ($R = 0.1$, $K_t = 1$) of 110 Ksi or above;

Yet a further object is to provide an alloy steel having a $K_{ISCC}$ of 60 Ksi $\sqrt{\text{inch}}$ as a minimal value at the highest strength level and which increases to above 100 Ksi $\sqrt{\text{inch}}$ at decreasing yield strengths according to the following relationship: $K_{ISCC} = a\ TYS + b$ where $a = -1.143$ and $b = 340$.

Accordingly, steels meeting the above and other requirements and objects are found to be attainable when consisting essentially of 0.12% - 0.17% carbon, 1.8% - 3.2% chromium, 0.9% - 1.35% molybdenum, 11.5% - 14.5% cobalt, and 9.5% - 10.5% nickel, all as percents by weight, the remainder being substantially iron, i.e., with minor amounts of impurities and residual elements. Minor amounts of manganese may also be present. In these steels it is necessary to maintain the solid and gaseous impurity elements, e.g., S, P, Al, O, N, etc. at low levels for greater toughness and stress corrosion resistance. Advantageously the above compositions are achieved using high purity melt practices, which may be high purity charges with vacuum induction melting, and may further include vacuum arc remelting, or other melt practices resulting in the high purities as taught herein may be employed. Toughness is somewhat variable depending on the way and degree to which the steel is subjected to mechanical working, i.e., by rolling, forging or the like prior to final heat treatment, as will be understood.

To produce the best range of qualities, the above stated impurities and residuals advantageously are held to amounts not exceeding 0.1% silicon, 0.01% aluminum, 0.01% titanium, 0.005% sulphur, 0.12% phosphorous, all in percents by weight, and having not more than 40 parts per million nitrogen and 25 parts per million oxygen.

Steels in accordance with the invention are found to have desirable stress corrosion resistance of 60 Ksi $\sqrt{\text{inch}}$ or above at a yield strength of about 245 Ksi. Also, stress corrosion resistance is seen to increase to 100 Ksi $\sqrt{\text{inch}}$ with decreasing yield strengths to 210 Ksi TYS according to the relationship $K_{ISCC} = a\ TYS + b$, where $a = 1.143$ and $b = 340$. Ultimate strength ranges from about 220 Ksi to about 270 Ksi and fracture toughness is produced in the range of from 115 Ksi $\sqrt{\text{in.}}$ to about 160 $\sqrt{\text{in.}}$ Using conventional arc welding techniques, weld strengths may be produced which equal or exceed the strength levels of the parent metal. Moreover, steels of the present invention retain notch toughness, e.g., in the range of 13–25 ft-lbs absorbed energy at yield strengths up to about 210–228 Ksi at the cryogenic (+320° F.) temperatures.

Using $K_{ISCC}/k_{IC}$ versus yield strength correlation steels of this invention equal or exceed a $K_{ISCC}/K_{IC}$ ratio of 0.5 at a yield strength in excess of 210 Ksi, and have the desired fatique endurance limit properties.

The optimum combination of properties provided for in accordance with the invention advantageously may be obtained when the steel is double austenitized respectively at about 1650° F. and about 1500° F. with water quenching at each interim followed by aging at about 890° F. to about 960° F. for a period of from 1–20 hours.

It has also been found that weldable steels having very high levels of stress corrosion resistance in combination with high fracture toughness at the higher strength levels can be produced in accordance with this invention when the essential alloy elements are present in the ranges of 0.15% to 0.17% carbon, 13.5% to 14.5% cobalt, 1.8% to 2.2% chromium, 0.9% to 1.1% molybdenum and 9.5% to 10.5% nickel all in percents by weight. With this composition it has been found beneficial for the purpose of optimizing the desired characteristics to maintain impurities and residuals at levels not exceeding 0.1% silicon, 0.01% aluminum, 0.01% titanium, 0.004% sulphur, 0.008% phosphorous and having not more than 20 parts per million nitrogen, 15 parts per million oxygen, and 3 parts per million hydrogen. Also, when present, the following other residuals are advantageously held to amounts not exceeding the following: vanadium — 0.02%, tin — 0.002%, lead — 0.002%, zirconium — 0.002%, boron — 0.0005%, and rare earths — 0.01%, all percents by weight of the steel. Steels of these compositions are preferred for simultaneously providing the optimum combination of high strength, high fracture toughness and stress corrosion resistance throughout the range of aging temperatures of from about 900° to about 950° F. Fatigue endurance limit properties also appear optimized.

BRIEF DESCRIPTION OF THE DRAWINGS

The above and further objects and advantages of the invention will become more evident to those skilled in the art from attention to the above and to the discussion and data following including specific examples and in which.

DESCRIPTION OF THE PREFERRED EMBODIMENTS

Figure 1:
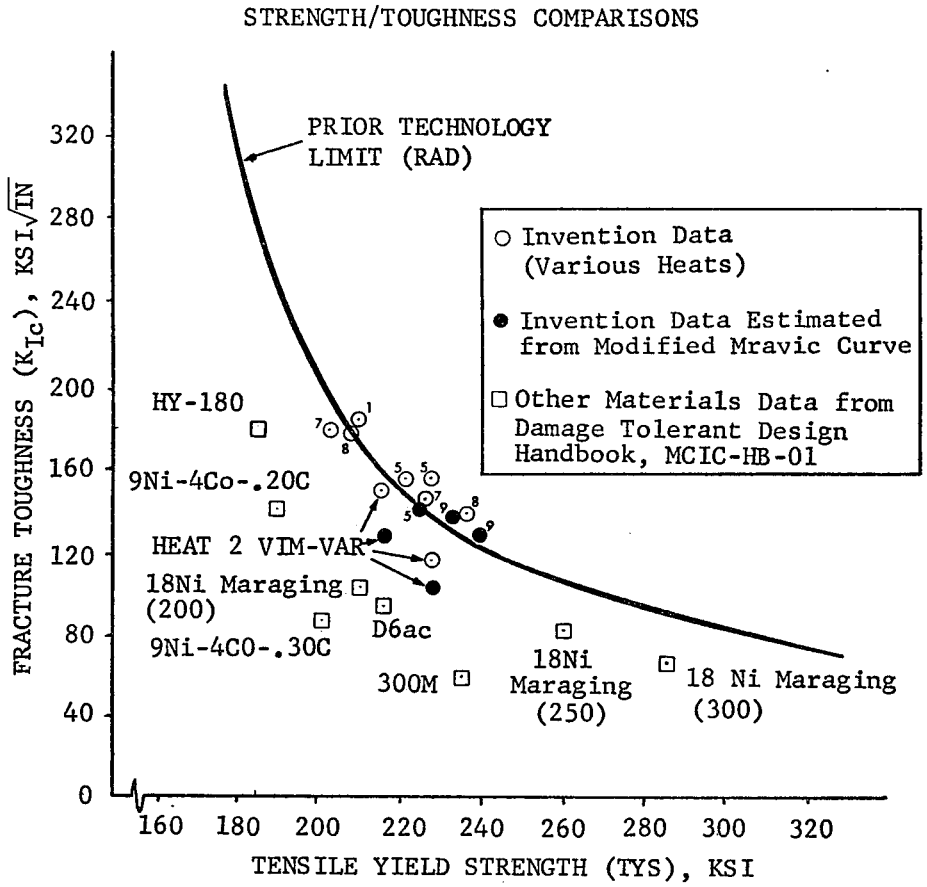
FIG. 1 shows the relation between fracture toughness and tensile yield strength for various steel heats of the invention relative to other commercially available steels.

The chemical analysis of several heats melted to the desired compositions is given in Table I.

Table I

| Heat No. | C | Mn | P | S | Si | Ni | Cr | Mo | Co | Total Al | Ti | N | O,ppm. |
|---|---|---|---|---|---|---|---|---|---|---|---|---|---|
| | | | | | | Rolled Plate Analysis | | | | | | | |
| 1 | 0.12 | 0.18 | 0.001 | 0.002 | 0.056 | 10.07 | 2.01 | 1.00 | 12.10 | 0.01 | 0.002 | 0.003 | 25 |
| 2[a] | 0.14 | 0.16 | 0.012 | 0.005 | 0.045 | 10.22 | 1.93 | 1.21 | 13.89 | 0.01 | 0.008 | 0.001 | 20 |
| 2[b] | 0.14 | 0.12 | 0.010 | 0.004 | 0.039 | 10.26 | 1.92 | 1.20 | 13.95 | 0.01 | 0.007 | 0.001 | 6 |
| 5 | 0.16 | 0.16 | 0.001 | 0.003 | 0.051 | 10.05 | 1.97 | 1.00 | 13.88 | 0.01 | 0.002 | 0.002 | 22 |
| 6 | 0.15 | 0.16 | 0.001 | 0.003 | 0.058 | 10.08 | 2.01 | 1.22 | 12.15 | 0.01 | 0.002 | 0.003 | 24 |
| 7 | 0.15 | 0.16 | 0.001 | 0.003 | 0.049 | 10.06 | 2.97 | 1.00 | 12.05 | 0.01 | 0.003 | 0.004 | 23 |
| 8 | 0.17 | 0.16 | 0.001 | 0.003 | 0.048 | 10.02 | 2.97 | 1.21 | 13.74 | 0.01 | 0.003 | 0.002 | 18 |
| 9[c] | 0.16 | 0.06 | 0.007 | 0.003 | 0.04 | 10.15 | 1.95 | 0.98 | 13.80 | 0.009 | 0.01 | 0.002 | 9 |

NOTES:
All heats 300 lb VIM heats except as noted
[a]2000 lb VIM heat
[b]1700 lb VIM-VAR Ingot
[c]2000 lb VIM-VAR Ingot Using conventional ingot reduction processing, the ingots were reduced to two inch-thick plates which were cross-rolled to 0.5, 0.625 and 1.25 inch thick rolled plates. Table II shows the experimental mechanical properties of these heats as a function of melt practice, plate thickness, plate orientation and aging temperature.

TABLE II

| Heat No | Plate Thickness Inch | Specimen Orientation | Age Treatment (5 Hrs) ° F | Yield Strength (0.2% Offset) KSI | Tensile Strength KSI | Elongation in 1 Inch % | Reduction of Area % | CVN Energy Absorption 80° F, Ft-Lb. | $KI_c$ KSI $\sqrt{Inch}$ | KISCC KSI $\sqrt{Inch}$ |
|---|---|---|---|---|---|---|---|---|---|---|
| 1 | 0.5 | LT | 900 | 213.9 | 238.5 | 15.5 | 64.0 | 55.1 | | |
| | 0.5 | TL | 900 | 219.5 | 239.4 | 13.0 | 63.9 | 42.3 | | |
| | 0.5 | LT | 950 | 210.7 | 218.2 | 16.5 | 68.9 | 73.0 | | |
| | 0.5 | TL | 950 | 205.4 | 218.1 | 16.5 | 70.0 | 57.7 | | |
| 2[a] | 0.5 | LT | 900 | 231.0 | 254.1 | 13.5 | 61.1 | 28.8 | | |
| | 0.5 | LT | 950 | 216.5 | 225.9 | 14.5 | 61.2 | 37.0 | | |
| | 1.25 | LT | 950 | 215.0 | 225.3 | 15.0 | 58.5 | 29.7 | 102.3 | |
| 2[b] | 0.5 | LT | 900 | 228.0 | 252.6 | 14.0 | 64.5 | 35.6 | | |
| | 1.00 | LT | 900 | — | — | — | — | — | 105.8 | |
| | 1.25 | LT | 900 | 229.3 | 253.5 | 14.0 | 63.2 | 32.1 | 105.8 | |
| | 0.5 | LT | 950 | 215.8 | 227.7 | 16.0 | 67.4 | 48.3 | | |
| | 0.5 | TL | 950 | 216.4 | 229.3 | 16.3 | 65.6 | 46.7 | | |
| | 1.25 | LT | 950 | 217.6 | 230.2 | 15.5 | 65.0 | 39.0 | 126.3 | 100.3 |
| 5 | 0.5 | LT | 900 | 237.3 | 261.7 | 15.0 | 66.7 | 35.6 | | |
| | 0.5 | TL | 900 | 236.1 | 261.1 | 11.0 | 57.1 | 29.3 | | |
| | 1.25 | LT | 900 | 241.8 | 266.8 | 12.0 | 52.0 | 28.9 | 94.6 | |
| | 0.5 | LT | 925 | 228.7 | 248.9 | 16.5 | 68.1 | 50.3 | | |
| | 0.5 | TL | 925 | 238.0 | 259.3 | 13.0 | 61.3 | 37.1 | | |
| | 0.5 | LT | 950 | 222.0 | 238.0 | 16.0 | 67.8 | 49.7 | | |
| | 0.5 | TL | 950 | 225.8 | 239.0 | 16.0 | 65.3 | 48.0 | | |
| | 1.25 | LT | 950 | 225.5 | 242.5 | 15.8 | 65.5 | 44.5 | | |
| | 1.25 | TL | 950 | 225.5 | 242.0 | 15.5 | 65.8 | 42.3 | 142.0 | |
| 6 | 0.5 | LT | 950 | 216.7 | 237.0 | 16.0 | 67.0 | 42.3 | | |
| | 0.5 | TL | 950 | 219.7 | 239.7 | 16.0 | 61.2 | 33.0 | | |
| 7 | 0.5 | LT | 900 | 226.4 | 252.9 | 15.5 | 64.6 | 44.3 | | |
| | 0.5 | LT | 950 | 203.1 | 214.7 | 18.0 | 69.2 | 69.0 | | |
| | 0.5 | TL | 950 | 204.2 | 215.0 | 16.5 | 67.5 | 57.3 | | |
| 8 | 0.5 | LT | 900 | 235.9 | 262.0 | 15.5 | 62.7 | 41.2 | 133.0 | 101.6 |
| | 0.5 | TL | 900 | 240.6 | 265.1 | 11.0 | 57.1 | 31.2 | | |
| | 0.5 | LT | 925 | 220.0 | 233.2 | 15.0 | 66.3 | 55.0 | | |
| | 0.5 | TL | 925 | 231.3 | 251.2 | 13.0 | 63.1 | 41.1 | | |
| | 0.5 | LT | 950 | 208.2 | 218.0 | 16.0 | 69.2 | 65.6 | 168.7 | |
| | 0.5 | TL | 950 | 211.4 | 219.5 | 16.0 | 67.2 | 57.3 | | |
| 9[c] | 0.625 | LT | 900 | 242.8 | 268.8 | 13.3 | 59.7 | 31.4 | 126.7 | 77.8 |
| | 0.625 | TL | 900 | 245.0 | 270.4 | 13.8 | 61.9 | 32.0 | | |
| | 0.625 | LT | 950 | 230.0 | 245.0 | 14.0 | 65.2 | 46.6 | | |
| | 0.625 | TL | 950 | 226.0 | 239.0 | 14.7 | 67.5 | 51.3 | | |
| | 1.25 | LT | 950 | 240.7 | 255.8 | 16.0 | 66.7 | 42.2 | 126.6 | 98.1, 102.2 |

TABLE II-continued

| Heat No | Plate Thickness Inch | Specimen Orientation | Age Treatment (5 Hrs) ° F | Yield Strength (0.2% Offset) KSI | Tensile Strength KSI | Elongation in 1 Inch % | Reduction of Area % | CVN Energy Absorption 80° F, Ft-Lb. | $KI_c$ KSI $\sqrt{Inch}$ | KISCC KSI $\sqrt{Inch}$ |
|---|---|---|---|---|---|---|---|---|---|---|
| | 1.25 | TL | 950 | 234.9 | 254.3 | 15.4 | 67.5 | 45.5 | 137.6 | 108.8, 111.9 |

NOTES:
All plate specimens were austenitized at 1650° F for 1.25 hr. (1.25 in-t) and 1500° F for 1.0 hr. (0.625 in-t) at each temperature with water quenching at each interim. Aging was accomplished as indicated followed by water quench. All mechanical tests are representative of 0.50–0.625 or 1.25 inch thick plate midthickness locations which are obtained from standard tension, full size Charpy V-Notch Impact Test, and fracture toughness compact tension specimens.
Room Temperature Data.
$KI_c$ KISCC data were obtained from valid sized specimens.
All heats 300 lb VIM heats except as noted
[a]2000 lb VIM heat
[b]1700 lb VIM-VAR Ingot
[c]2000 lb VIM-VAR Ingot All the plate material was double solution treated at the 1650° and 1500° F. temperatures with water quenching at each interim to obtain a homogeneous austenite prior to transformation to martensite and then aged at secondary hardening temperatures in the range of from about 900° F. to 950° F. Heat No. 9 was also aged at other temperatures (See FIG. 2).

The secondary hardening features of these steels allow the yield strength to increase simultaneously with fracture toughness over a narrow temperature range. This may be seen in the example of FIG. 2 at the areas of the peaks of the curves at the secondary hardening temperatures. By control of the aging precipitate in the 900° F. - 950° F. temperature range it is possible to obtain a wide range of strength properties, i.e., 220–270 Ksi ultimate strength with accompanying notch toughness of 30–65 ft-lbs for the alloys in Table II. Samples 5 and 8 will be used for illustration. Sample 5 when aged at 950° F. will attain 226 Ksi yield strength and 242 Ksi ultimate strength with corresponding notch toughness of 42 ft-lbs and fracture toughness of $K_{IC}$ = 142 Ksi $\sqrt{inch}$. Aging at 900° will increase the yield strength to 242 Ksi, the tensile strength to 267 Ksi and decrease the notch toughness and fracture toughness to 29 ft-lbs and $K_{IC}$ = 95 Ksi $\sqrt{inch}$ respectively. Control of contributing elements, i.e., C. Co, Cr, Mo are necessary to attain the unique secondary hardening by which alloy precipitates form in a high toughness matrix. Massive or lath martensite which provides a high fracture toughness matrix is present in low carbon (generally less than 0.3%) steels and dilute iron-nickel steel alloys. In such steels the substructure consists predominantly of a high density of tangled dislocations within the parallel laths which accounts for this inherent toughness. As is known, strength tends to decrease with a decrease in carbon. However, in the present steels carbon was controlled below 0.18% which was found to result in a high degree of strength while maintaining high toughness with high stress corrosion resistance and a high degree of weldability. Nickel was maintained in the range from 9.5% to 10.5% which was found to be an optimum content to assure a high toughness martensitic matrix and provide fracture resistance at cryogenic temperatures. This can be seen from steel samples 5 and 8 which when aged at 925° F. and tested for notch impact toughness at liquid nitrogen temperatures resulted in 13 and 25 ft-lbs, respectively.

Tempering in the lower temperature ranges of up to about 850° F. of the lath martensites in the present steels results in iron carbide segregation to lath boundaries and prior austenite grain boundaries. This behavior is not different from a conventional quench and temper carbon steel with carbon contents below 0.20%. However, in the present steels heat treating in the higher ranges, i.e., above about 850° F. is found to provide an additional reaction involving alloy carbides and not found in the plain carbon steels such that high stress corrosion resistance and high fracture toughness can be achieved at high strengths. The addition of cobalt besides providing solid solution strengthening retards the annealing out of the lath martensite substructure which would otherwise occur in plain carbon steels. This ability of cobalt in steels of this invention to retard the recovery of the high dislocation density at aging temperatures of 900° - 950° F. appears to provide for preferred sites for the precipitation of alloy carbides, thus allowing secondary hardening. But cobalt above 10% has been previously reported to be detrimental to toughness. In the present alloy steels, however, an 11.5% to 14.5% cobalt content surprisingly provides considerable strength increase at the lower carbon levels with only a small penalty for loss in toughness, (reference samples 5 and 9).

Without the presence of molybdenum, the secondary hardening reaction does not occur. At the 220–270 Ksi ultimate strength level, a 0.25% by weight increase over a 1.0% molybdenum level resulted in a slight loss of toughness. The major role of chromium besides combining with molybdenum and carbon to form the alloy carbide is to increase the kinetics of the aging reaction and also to allow it to occur at lower temperatures where no interference from retained austenite will result. As an example, steels 5 and 8 have similar compositions except for chromium content. A 1% by weight increase in chromium in steel 8 resulted in a differential of 44 Ksi ultimate strength with a 50° F. change in aging temperature, while steel 5 at 2% chromium, has a 24 Ksi ultimate strength differential over the same temperature range.

To obtain the optimum balance between fracture toughness, stress corrosion resistance, and fatigue endurance limit at an intermediate ultimate strength of 250 Ksi, a composition of 0.15% to 0.17% carbon, 1.8% to 2.2% chromium, 0.9% to 1.1% molybdenum, 13.5% to 14.5% cobalt, and 9.5% to 10.5% nickel results in steels providing close to optimum combinations of strength, fracture toughness, stress corrosion resistance and fatigue properties. Typical mechanical properties for this chemical composition set forth in Table III are as follows: TYS — 241 Ksi, TUS — 255 Ksi, $K_{IC}$ (126–137) Ksi $\sqrt{inch}$ and $K_{ISCC}$ (98–112) Ksi $\sqrt{inch}$, (see Table II — ht. 9.)

TABLE III

| Elements | Chemical Composition Nominal | Rolled Plate Chemistry** |
|---|---|---|
| Co | 14.0 ± 0.5 | 13.80 |
| Ni | 10.0 ± 0.5 | 10.15 |

TABLE III-continued

| Elements | Chemical Composition Nominal | Rolled Plate Chemistry** |
|---|---|---|
| Cr | 2.0 ± 0.2 | 1.95 |
| Mo | 1.0 ± 0.1 | 0.98 |
| C | 0.16± 0.01 | 0.16 |
| Mn | 0.15+ 0.05 − 0.10 | 0.06 |
| Si | * 0.10 MAX | 0.04 |
| Al | * 0.01 MAX | 0.009 |
| Ti | * 0.01 MAX | 0.01 |
| V | * 0.02 MAX | 0.015 |
| Sn | * 0.002 MAX | 0.001 |
| Pb | * 0.002 MAX | 0.001 |
| Zr | * 0.002 MAX | 0.002 |
| B | * 0.0005 MAX | 0.0003 |
| Rare Earths | * 0.01 MAX | <0.01 |
| S | * 0.004 MAX | 0.003 |
| P | * 0.008 MAX | 0.007 |
| O | * 15 ppm | 9 ppm |
| N | * 20 ppm | 20 ppm |
| H | * 3 ppm | — |

* None added
** Sample No. 9

The fatigue endurance limit at 10 million cycles established for this particular alloy is 160–170 Ksi at a $K_t$ = 1 and R = 0.1, Table IV.

TABLE IV

S/N AXIAL FATIGUE PROPERTIES
Heat No. 9 - 0.625 inch thick plate
LT Orientation

| Specimen Ident | Width Inch | Thickness Inch | Hole Diameter Inch | Net. Fatigue Stress Ksi | Cycles to Failure $K_c$ | Remarks |
|---|---|---|---|---|---|---|
| | | | $K_t$ = 1.0, R = 0.1 | | | |
| 9C-70 | .651 | .253 | | 180 | 1288 | LHF |
| 9C-71 | .651 | .255 | | 160 | 494 | LHF |
| 9C-72 | .649 | .250 | | 220 | 27 | F |
| 9C-73 | .649 | .252 | | 160 | 10208 | NF |
| 9C-73R | .649 | .252 | | 220 | 22 | F |
| 9C-74 | .648 | .255 | | 190 | 3099 | LHF |
| 9C-75 | .647 | .254 | | 190 | 7826 | F |
| | | | $K_t$ = 2.4, R = 0.1 | | | |
| 9C103 | 1.384 | .142 | .378 | 70 | 10129 | NF (Polished) |
| 9C103R | 1.384 | .142 | .378 | 110 | 60 | F (Polished) |
| 9C104 | 1.405 | .250 | .376 | 110 | 23 | FP |
| 9C108 | 1.395 | .252 | .376 | 110 | 19 | FP |
| 9C105 | 1.405 | .249 | .376 | 80 | 143 | FP |
| 9C106 | 1.391 | .242 | .377 | 70 | 66 | FP |
| 9C107 | 1.385 | .253 | .377 | 80 | 2553 | LHF (Polished) |

Figure 3:
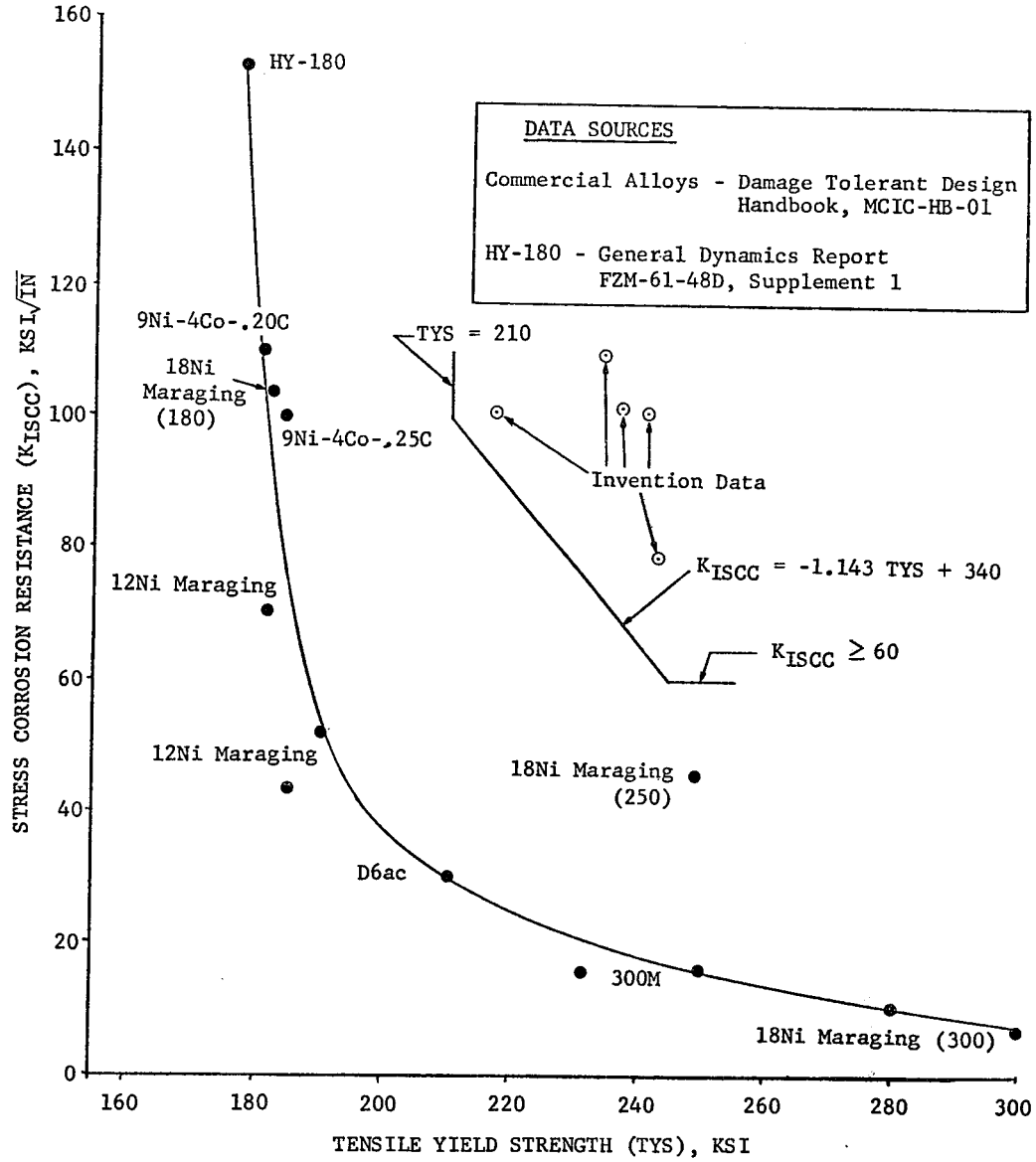
FIG. 3 shows a correlation between stress corrosion resistance and tensile yield strength of steels of this invention compared with other commercial steels.
Figure 4:
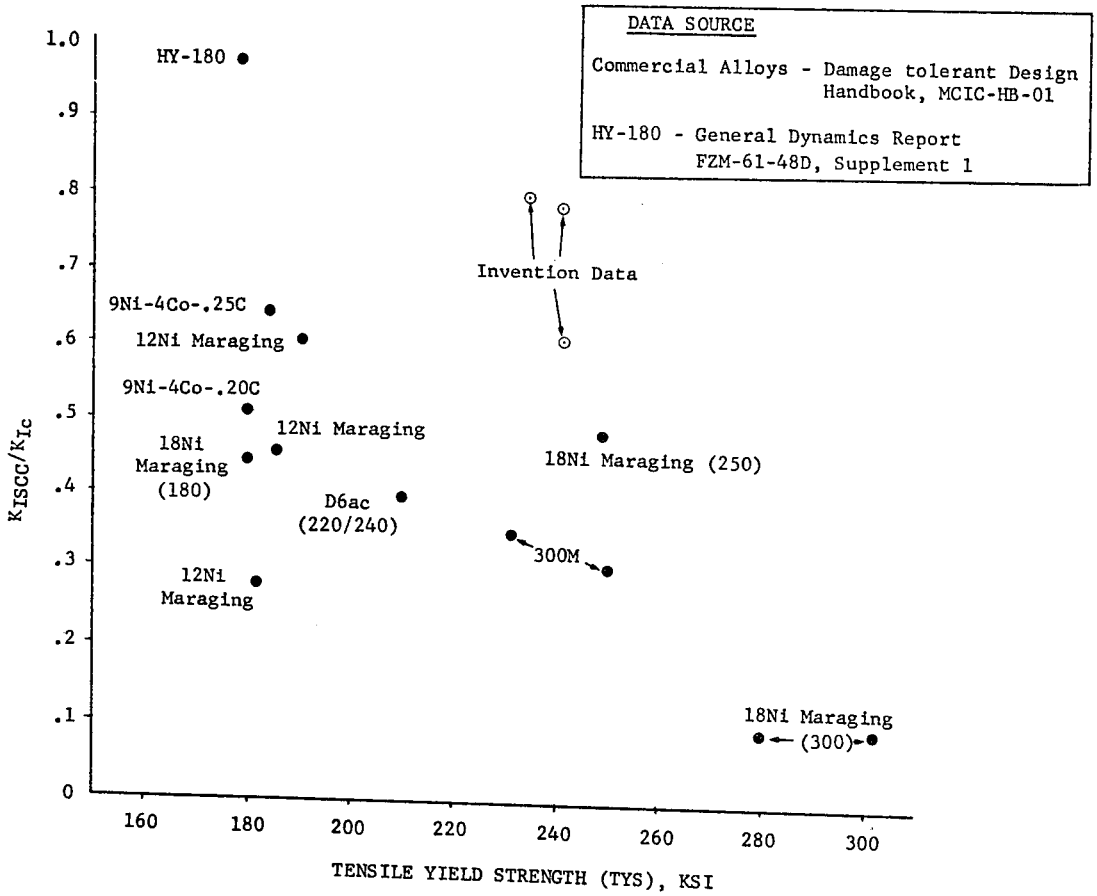
FIG. 4 provides a correlation between the ratio of stress corrosion resistance to fracture toughness as it relates to tensile yield strength for steels of the invention in comparison to other commercial steels.

Notes:
Flat Specimen Data
NF - No Failure
LHF - Loading Hole Failure
F - Net Section Failure
FP - Failure - Poor Hole Preparation By control of the aging precipitate in the 850° – 1000° F. temperature range it is possible to obtain a wide range of strength, stress corrosion, and fracture toughness properties (see FIG. 2). Sample 9, however, when aged in the range of 900° – 950° F. results in consistently higher fracture toughness (FIG. 1) and stress corrosion resistance (FIG. 3) than reported for commercially available steels. In addition a $K_{ISCC}/K_{IC}$ of greater than 0.6 and is maintained over the entire strength range, and a ratio of 0.8 is achievable (FIG. 4).

Figure 2:
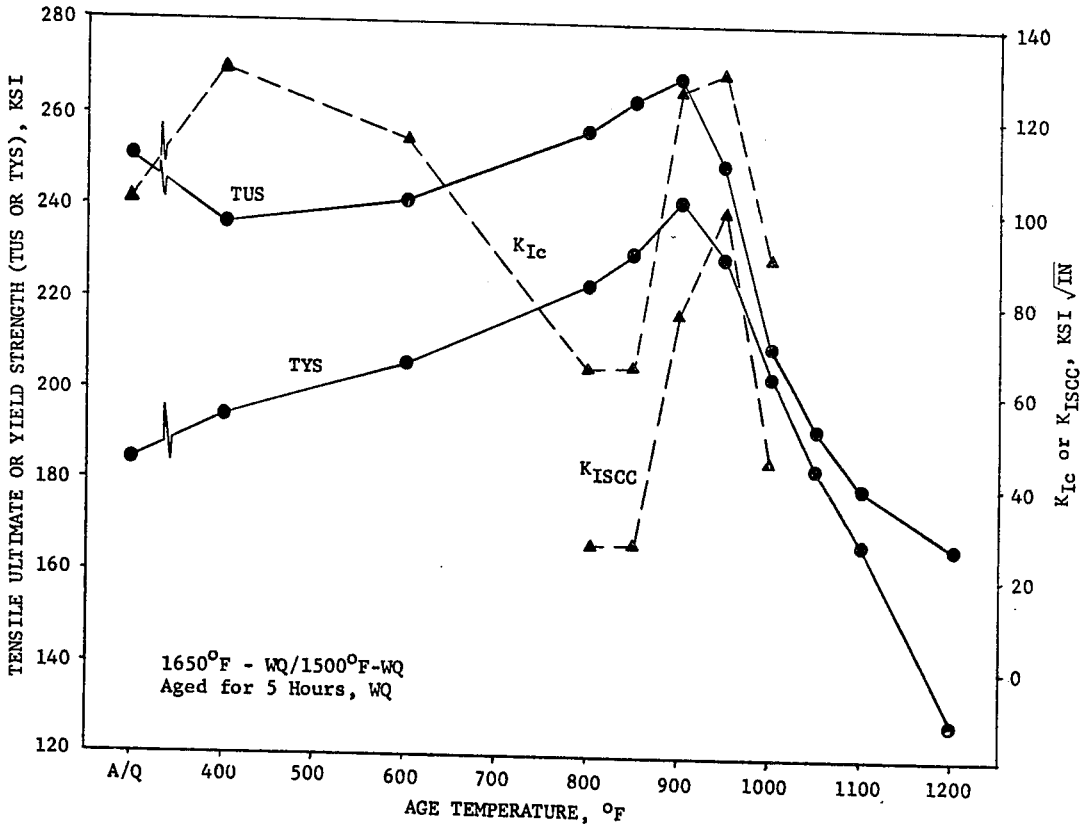
FIG. 2 illustrates the relationships of yield strength, ultimate strength, fracture toughness, and stress corrosion resistance as a function of aging temperatures for the present steels.

With reference to FIG. 2 showing representative values for heat or sample 9, following is a brief description of microstructural differences evident at aging temperatures of interest: 800° to 850° F. — The tempering of the low carbon martensite in this steel results in iron carbide segregation to lath boundaries and prior austenite grain boundaries, as previously discussed. As also stated this does not differ from a normal quench and temper carbon steel with carbon contents below 0.20% (i.e., the plain carbon steels). Apparently coarsened cementite present at nonoptimum sites is responsible for the relatively low levels in both stress corrosion resistance and fracture toughness, which appear in the FIG. 2 curves. 850° to 900° F. — In this range strength is seen to approach and reach maximums at about 900° F. with substantial improvements in stress corrosion resistance and toughness. At the latter temperature the highly dislocated lath substructure is intact thus providing sites for the dislocation-nucleated alloy carbide precipitates. Plate shaped cementite is present predominantly at interlath locations and from data on this heat appeared to be dissolving in favor of a fine dispersion of $M_xC$ alloy carbides. 900° to 950° F. — From the aging temperatures of from about 900° to about 950° F. the tensile strength is seen to slightly decrease with a concomitant increase in stress corrosion resistance. It would appear that when the alloy carbides constitute a major portion of the total precipitation the stress corrosion properties are greatly enhanced. Whatever the precise reasons it is this behavior that is unique in the invention steel. Microstructural evidence indicates that the alloy carbides have grown to the extent that the coherency strains present at 900° F. have diminished. Also the alloy carbides are of the $M_xC$ type with Cr and Mo constituting the metallic atoms. These factors would appear also to relate to the causes of the optimum characteristics obtained. 950° to 1000° F. — In this range, a rapid drop in strength, stress corrosion resistance and fracture toughness occurs. The decrease in $K_{IC}$ and $K_{ISCC}$ appear to be associated with the growth of nonstoichiometric alloy carbides to $Mo_2C$ and formation of other spherical alloy carbides which form at nonoptimum sites. Thus the fracture toughness and stress corrosion resistance properties of these steels apparently are quite dependent on the chemistry, size, shape and location of the carbides which precipitate upon aging.

Sample heats melted in accordance with the invention should not exceed 2150° F. during reduction in order to obtain optimum properties. Advantageously each reduction, i.e., by rolling, should be to a ratio of about 3:1 or better which is particularly important should that temperature be exceeded.

It will be appreciated that when the vacuum induction melting (VIM) provides sufficient purity to the levels taught herein additional melting may not be required. Vacuum arc remelting is indicated where the vacuum induction melting has not achieved those levels as will be understood.

Various modification may be made by those skilled in the art without departing from the spirit and scope of the invention as defined in the appended claims.

What is claimed is:

1. A weldable alloy steel having high strength and high fracture toughness consisting essentially of 0.12% - 0.17% carbon, 1.8% - 3.2% chromium, 0.9% - 1.35% molybdenum, 11.5% - 14.5% cobalt, and 9.5% - 10.5% nickel, all as percents by weight, the remainder being iron with minor amounts of impurities and residual elements, said steel having an ultimate tensile strength of from about 220 Ksi to about 270 Ksi, a tensile yield strength of from about 210 Ksi to about 245 Ksi and a fracture toughness ($K_{IC}$) greater than about 115 Ksi $\sqrt{\text{inch}}$.

2. The alloy steel of claim 1 in which manganese is present in an amount of from 0.05% to 0.20% by weight of the steel.

3. The alloy steel of claim 1 in which the most common impurities and residuals are present in amounts not exceeding 0.1% silicon, 0.01% aluminum, 0.01% titanium, 0.005% sulphur, and 0.012% phosphorous, all as percents by weight, and having not more than 40 parts per million nitrogen and 25 parts per million oxygen.

4. The alloy steel of claim 1 in which said steel is produced by melt processing followed by steps of mechanical working and double austenitizing prior to aging.

5. The alloy steel of claim 4 in which the melt processing is accomplished using vacuum induction melting.

6. The alloy steel of claim 5 in which the melt processing further includes vacuum arc remelting.

7. The alloy steel of claim 4 in which the steel is aged at from about 890° to about 960° F. for from about 1 to about 20 hours total time.

8. The alloy steel of claim 1 having a stress corrosion resistance ($K_{ISCC}$) of at least 60 Ksi $\sqrt{\text{inch}}$ in the range of 220 Ksi to 270 Ksi tensile ultimate strength when tested for 1,000 hours in 3.5% sodium chloride solution.

9. The alloy steel of claim 1 which has a stress corrosion resistance ($K_{ISCC}$) greater than 60 Ksi $\sqrt{\text{inch}}$ over a yield strength range of 210–245 Ksi, and which increases with decreasing yield strength (TYS) according to the relationship:

$$K_{ISCC} = a\,\text{TYS} + b$$

where $a = -1.143$ and $b = 340$.

10. The alloy steel of claim 1 in which the ratio of stress corrosion resistance ($K_{ISCC}$) to fracture toughness ($K_{IC}$) is at least about 0.5 when tensile ultimate strength is in the range of 220 Ksi or above.

11. The alloy steel of claim 1 which exhibits a fatigue endurance limit at $10^7$ cycles ($R = 0.1$, $K_t = 1$) of 110 Ksi or above.

12. The alloy steel of claim 1 in which the alloying elements are present in the ranges of 0.15% - 0.17% carbon, 13.5% - 14.5% cobalt, 1.8% - 2.2% chromium, 0.9% - 1.1% molybdenum, 9.5% - 10.5% nickel all as percents by weight.

13. The alloy steel of claim 12 in which manganese is present in an amount of from 0.05% to 0.20% by weight of the steel.

14. The alloy steel of claim 12 in which the most common impurities and residuals are present in amounts not exceeding 0.1% silicon, 0.01% aluminum, 0.01% titanium, 0.004% sulphur, 0.008% phosphorous and having not more than 20 parts per million nitrogen, 13 parts per million oxygen, and 3 parts per million hydrogen.

15. The alloy steel of claim 12 in which the steel is produced by melt processing followed by steps of mechanical working and double austenitizing prior to aging.

16. The alloy steel of claim 15 in which the melt processing is accomplished using vacuum induction melting.

17. The alloy steel of claim 16 in which the melt processing further includes vacuum arc remelting.

18. The alloy steel of claim 15 in which the steel is aged at from about 900°to about 950° F. for from about 1 to about 20 hours total time.

19. The alloy steel of claim 12 which has an ultimate tensile strength of from about 235 Ksi to about 270 Ksi and a tensile yield strength of from about 220 Ksi to about 245 Ksi.

20. The alloy steel of claim 19 having a fracture toughness ($K_{IC}$) greater than about 125 Ksi $\sqrt{\text{inch}}$.

21. The alloy steel of claim 19 having a stress corrosion resistance ($K_{ISCC}$) of at least about 70 Ksi $\sqrt{\text{inch}}$ in the range of from about 235 Ksi to about 270 Ksi tensile ultimate strength when tested for 1,000 hours in 3.5% sodium chloride solution.

22. The alloy steel of claim 21 which has a stress corrosion resistance ($K_{ISCC}$) greater than about 70 Ksi $\sqrt{\text{inch}}$ over a yield strength range of from about 220 Ksi to about 245 Ksi, and which increases with decreasing yield strength (TYS) according to the relationship:

$K_{ISCC} = a\ TYS + b$ where: $a = -1.143$ and $b = 350$.

23. The alloy steel of claim 19 in which the ratio of stress corrosion resistance ($K_{ISCC}$) to fracture toughness ($K_{IC}$) is at least about 0.6 when tensile ultimate strength is in the range of about 235 Ksi or above.

24. The alloy steel of claim 19 which exhibits a fatigue endurance limit at $10^7$ cycles ($R = 0.1$, $K_t = 1$) of about 150 Ksi or above.

25. The alloy steel of claim 14 in which there are additional residuals which when present do not exceed the following amounts: vanadium — 0.02%, tin — 0.002%, lead — 0.002%, zirconium — 0.002%, boron — 0.0005% and rare earths — 0.01%, all as percents by weight of the steel.

* * * * *